US008858730B2

(12) United States Patent
Chapman

(10) Patent No.: US 8,858,730 B2
(45) Date of Patent: Oct. 14, 2014

(54) BEVERAGE CAN CLEANING APPARATUS AND METHOD OF USE THEREOF

(76) Inventor: Peter Chapman, Atlanta, GA (US)

( * ) Notice: Subject to any disclaimer, the term of this patent is extended or adjusted under 35 U.S.C. 154(b) by 367 days.

(21) Appl. No.: 13/225,862

(22) Filed: Sep. 6, 2011

(65) Prior Publication Data

US 2013/0056030 A1 Mar. 7, 2013

(51) Int. Cl.

| | |
|---|---|
| ***B08B 7/04*** | (2006.01) |
| ***B08B 7/00*** | (2006.01) |
| ***B08B 3/00*** | (2006.01) |
| ***B08B 3/04*** | (2006.01) |
| ***B08B 9/093*** | (2006.01) |
| ***B08B 9/08*** | (2006.01) |
| ***B08B 9/42*** | (2006.01) |

(52) U.S. Cl.

CPC . *B08B 3/04* (2013.01); *B08B 9/093* (2013.01); *B08B 9/024* (2013.01); *B08B 9/0821* (2013.01); *B08B 9/423* (2013.01)

USPC ..... 134/58 R; 134/56 R; 134/57 R; 134/94.1; 134/99.1; 134/102.1; 15/316.1

(58) Field of Classification Search

USPC ..... 15/310, 311, 316, 304; 134/57 R, 58 R, 134/56 R, 94.1, 99.1, 102.1, 102.2

See application file for complete search history.

(56) References Cited

U.S. PATENT DOCUMENTS

| | | | |
|---|---|---|---|
| 4,183,115 | A | 1/1980 | Zakarian |
| 4,324,265 | A | 4/1982 | Fauth |
| 4,880,021 | A | 11/1989 | Haberstroh |
| 5,329,950 | A | 7/1994 | Barinas |
| 6,287,515 | B1 | 9/2001 | Koosman et al. |
| 7,520,020 | B1 | 4/2009 | Hutchens |
| 7,857,910 | B2 | 12/2010 | Carhuff et al. |
| 2003/0024554 | A1 | 2/2003 | Schultz et al. |

FOREIGN PATENT DOCUMENTS

| | | | | |
|---|---|---|---|---|
| JP | 08016914 | A | * | 1/1996 |
| JP | 2001229449 | A | * | 8/2001 |
| KR | 2003059587 | A | * | 7/2003 |
| WO | 2002066365 | A1 | | 8/2002 |

OTHER PUBLICATIONS

Translation of KR 2003059587.*

* cited by examiner

*Primary Examiner* — Alexander Markoff

(74) *Attorney, Agent, or Firm* — Mathew L. Grell; Balser & Grell IP Law

(57) ABSTRACT

A beverage can cleaning apparatus for cleaning beverage cans before they are dispensed from vending machines. The apparatus has a can holder, a hinged platform, tubes, a first nozzle, a second nozzle and a sensing block that matches the profile of the can top periphery. The sensing block is depressed a compressed distance, the distance being dependent on the orientation of the can, and cleaning fluid or compressed air is selectively directed through the first or second nozzle. Subsequent to air or cleaning fluid being dispensed against the top of the beverage can, the can holder releases the hinged platform sending the beverage can into the vending machine's dispenser.

10 Claims, 4 Drawing Sheets

BEVERAGE CAN CLEANING APPARATUS AND METHOD OF USE THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE INVENTION

1. Technical Field of the Invention

The present invention relates generally to beverage can sanitation, and more specifically to an apparatus for cleaning the top of a beverage can, particularly when dispensed by a vending machine.

2. Description of Related Art

Vending machines are ubiquitous, and they can provide anything from cigarettes and beverage cans to cell phones. While vending machine technology, and specifically beverage can vending machine technology, has stabilized, there remains no adequate solution for providing beverage cans with a drinking surface that is generally clean of debris.

To address this issue, it was previously proposed to clean beverage cans immediately after the beverage can top was affixed to the beverage can. A problem with this approach is that the beverage cans would need to be vertically oriented for the cleaning mechanism to have any effect. Moreover, during packaging, transportation and vending, there are many opportunities for the beverage can top to become contaminated.

One proposed solution to this problem was to provide a mechanism that would vertically orient beverage cans from the horizontal position. A problem with this approach was that the beverage cans might be oriented with the opening facing down, thus undermining the success of the resultant cleaning. Again, after cleaning, these cleaned cans would have the opportunity to become dirty once again.

Another approach was to clean beverage cans with water that has been treated with various chemicals. A problem with this approach is that is no consideration of where the can opening is located, and cleaning of the can other than its drinking surface (can top, typically) is wasteful.

Another approach was to use an apparatus that sprayed air onto the top of the can, the apparatus having vents that allow the sprayed air to exit the area around the can opening. Again, the problem with this approach is that, in order for the apparatus to function correctly, another device needs to identify and correctly orient the can opening.

Therefore, it is readily apparent that there is a need for an apparatus that will selectively clean the top of beverage cans.

BRIEF SUMMARY OF THE INVENTION

Briefly described, in a preferred embodiment, the present invention overcomes the above-mentioned disadvantages and meets the recognized need for such a device by providing an apparatus for cleaning beverage cans as they are dispensed from vending machines. The beverage can cleaning apparatus has a can holder, a sensing block, tubes, a first nozzle and a second nozzle. The sensing block is depressed a certain distance, the distance depending on the orientation of the can in the can holder. Subsequently, cleaning fluid and/or compressed air is directed through either the first or second nozzle against the top of the beverage can. Then, the can holder releases the beverage can into the vending machine's exit chamber.

According to its major aspects and broadly stated, the present invention in its preferred form is an apparatus for cleaning a beverage can, the beverage can having a can top and a can bottom. The apparatus has a holder, the holder has a sensing block, and the sensing block is depressed a selected distance when the beverage can is placed in the holder.

The beverage cleaner also has a rod and a sensor, the sensing block being secured to the rod, the rod being forced the aforementioned selected distance into contact with the sensor. The distance the rod is forced into contact with the sensor is equal to a first distance if the sensing block is in contact with the can top, and the distance is equal to a second distance if the sensing block is in contact with the can bottom. The beverage can cleaning apparatus also has a controller, and the controller is in electrical communication with the sensor via a wire. The sensor detects the aforementioned distance and communicates same to the controller via the wire.

The holder has a first vertical wall, and the can top or the can bottom is disposed near the first vertical wall when the beverage can is in the holder. The beverage can cleaning apparatus also has at least one nozzle disposed proximate to the first vertical wall, and the nozzle has apertures. The beverage can cleaning apparatus further has at least one nozzle tube that is in fluid communication with the nozzle. The nozzle is further disposed near the sensing block.

The beverage can cleaning apparatus also has a cleaning liquid container and a cleaning liquid tube that is in fluid communication with the cleaning liquid container, and the cleaning liquid tube is in fluid communication with the nozzle tube.

The beverage can cleaning apparatus can alternatively or additionally have a compressed air container and a compressed air tube, the compressed air tube being in fluid communication with the compressed air container, and the compressed air tube is in fluid communication with the nozzle tube.

The holder also has a second vertical wall, and the nozzle comprises a first nozzle and a second nozzle. The first nozzle is located near the first vertical wall and the second nozzle is located near the second vertical wall. The nozzle tube comprises a first nozzle tube and a second nozzle tube, the first nozzle tube being in fluid communication with the first nozzle, with the second nozzle tube being in fluid communication with the second nozzle.

The holder also has a platform that is hingedly secured to the holder, and the soda can rests on the platform when the soda can is in the holder.

In use, a beverage can is dispensed into the beverage can cleaning apparatus, the beverage can contacting the sensing block. As the can contacts the sensing block, the sensing block is depressed a distance consistent with whether the sensing block is in contact with the top or bottom of the beverage can, the sensing block being depressed a first distance if the sensing block is in contact with the can top, and the sensing block being depressed a second distance if the sensing block is in contact with the can bottom.

For illustrative purposes, if the surface of the sensing block is in contact with the lower perimeter of the soda can, because the sensing block's surface is contoured similarly to the upper perimeter of the soda can, and thus differently than the lower perimeter, the sensing block will be depressed a second distance, the second distance typically being greater than the first distance. However, and again for illustrative purposes, if the sensing block's surface is in contact with the upper perimeter of the soda can, because the sensing block's surface is contoured similarly to the upper perimeter, the sensing block will be depressed a first distance, the first distance typically being less than the second distance.

Subsequently, a cleaning solution or compressed air is selectively dispensed from the selected nozzle against the top of the beverage can, no matter its orientation. Specifically, the beverage can cleaning apparatus has a first nozzle and a second nozzle, and either the cleaning solution and/or compressed air is selectively dispensed from either the first nozzle or the second nozzle depending on can orientation, the selection being consistent with whether the sensing block is in contact with the top or bottom of the beverage can.

More specifically, the sensing apparatus has a sensing block, a rod, a spring and a sensor. The sensor has an uncompressed distance, a first distance, a second distance and a compressed distance. If no soda can is in the holder, then the rod is disposed at the uncompressed distance.

The beverage can cleaner is located within a vending machine near the machine's dispensing window, the vending machine typically being an automated machine for dispensing soda cans, wherein the soda cans exit the vending machine via the machine dispensing window. The soda can has a diameter, a bottom, a periphery and a top, the top having an opening, and the periphery having an upper perimeter and a lower perimeter, with the upper perimeter located near the top and the lower perimeter located near the bottom.

The ramps are angularly disposed, such that the ramp bottom is disposed lower than the ramp top, and the ramp bottom is fixedly secured to the holder.

The compressed air container is in fluid communication with the controller via the compressed air tube, and the cleaning liquid container is in fluid communication with the controller via the cleaning liquid tube. The controller is in fluid communication with the first nozzle tube and the second nozzle tube. The compressed air tube and the cleaning liquid tube are each selectively in fluid communication with the first nozzle tube and the second nozzle tube via the controller. The controller is in electrical communication with the sensing apparatus via the wire.

Preferably, the platform is hingedly secured to the side walls via the hinge. However, it will be recognized by those skilled in the art that the platform may be hingedly secured to the holder other than at or near the side walls.

The side walls are fixedly secured to the first vertical wall and the second vertical wall. The side walls preferably have two side walls, the two side walls being holder-diameter distance from each other, and the holder-diameter distance is approximately equal to the can's diameter.

The first nozzle tube is in fluid communication with the nozzle apertures of the first nozzle, and the second nozzle tube is in fluid communication with nozzle apertures of the second nozzle. In a preferred embodiment, the nozzle apertures are disposed peripherally equidistant from each other on the nozzle face. The first nozzle is disposed near the first vertical wall, and the second nozzle is disposed near the second vertical wall.

The rod of the sensing apparatus is preferably disposed through side walls, and the sensing block is fixedly secured to the rod. The rod is also secured to the sensor. The spring is preferably a resilient metal coil that is compressible and is disposed within the sensor. When compressed, the spring exerts a force on the rod urging the rod to its starting position. However, it will be recognized by those skilled in the art that the spring may comprise any compressible material that will exert an expanding force when compressed.

In use, the vending machine vends a soda can onto the ramp and the can periphery contacts the ramp. Gravity forces the soda can to roll towards the ramp bottom, and subsequently the soda can falls into the holder.

When the soda can is disposed within the holder, the sensing block is in contact with either the upper perimeter or the lower perimeter of the soda can, and the rod is forced to retract the compressed distance into the sensor. Because the upper perimeter and the lower perimeter are dimensioned differently, the rod compresses to the first-distance if the sensing block is in contact with the upper perimeter and compresses to the second-distance if the sensing block is in contact with the lower perimeter. The sensor subsequently communicates either the first-distance or the second-distance to the controller. Based on whether the sensor communicates the first-distance or the second-distance, the controller is able to determine whether the can top or the can bottom is disposed near the first nozzle.

If the sensor communicates the first-distance to the controller, then the controller selectively dispenses the cleaning liquid fluid through the first nozzle tube, via the nozzle apertures, spraying the cleaning liquid against the can's top. Subsequently, the controller selectively dispenses compressed air through the compressed air tube and the first nozzle tube, ultimately exiting from the nozzle apertures against the can's top, thereby drying same.

However, if the sensor communicates the second-distance to the controller, then the controller selectively dispenses the cleaning liquid via the second nozzle tube exiting from the nozzle apertures against the can's top. Subsequently, the controller selectively dispenses compressed air from the compressed air container via the compressed air tube and the second nozzle tube against the can's top, thereby drying same.

Following the dispensing of cleaning liquid and compressed air against the can's top, the controller rotates the platform about the hinge such that the end rotates away from the second vertical wall until the soda can falls into the machine exit chamber.

In a preferred embodiment, the liquid comprises an antibacterial substance approved by the U.S. Food and Drug Administration for the use described herein. It will be recognized by those skilled in the art that the liquid may comprise any substance that will clean the can's top, including, for exemplary purposes only and without limitation, water. Further, the cleaning liquid and the compressed air are preferably dispensed against the can's top for three seconds, but it will be recognized by those skilled in the art that the liquid and the compressed air can each respectively be dispensed against the cap top for any amount of time necessary to clean and dry the can top.

In a preferred embodiment, the controller also has a mechanism to regulate and/or increase the pressure of the liquid and the compressed air as they are dispensed via the nozzle tubes.

In an alternate embodiment, there is ramp and the vending machine dispenses soda cans directly into the holder.

Accordingly, a feature and advantage of the present invention is its ability to clean beverage cans.

Another feature and advantage of the present invention is its ability to identify the beverage can top.

Still another feature and advantage of the present invention is its ability to selectively direct a cleaning substance at the can top.

Yet another feature and advantage of the present invention is its ability to be easily incorporated into vending machines.

These and other features and advantages of the present invention will become more apparent to one skilled in the art from the following description and claims when read in light of the accompanying drawings.

BRIEF DESCRIPTION OF THE SEVERAL VIEWS OF THE DRAWINGS

The present invention will be better understood by reading the Detailed Description of the Preferred and Selected Alternate Embodiments with reference to the accompanying drawing figures, which are not necessarily drawn to scale, and in which like reference numerals denote similar structure and refer to like elements throughout, and in which.

DETAILED DESCRIPTION OF THE PREFERRED AND SELECTED ALTERNATE EMBODIMENTS OF THE INVENTION

In describing the preferred and selected alternate embodiments of the present invention, as illustrated in FIGS. 1-4, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
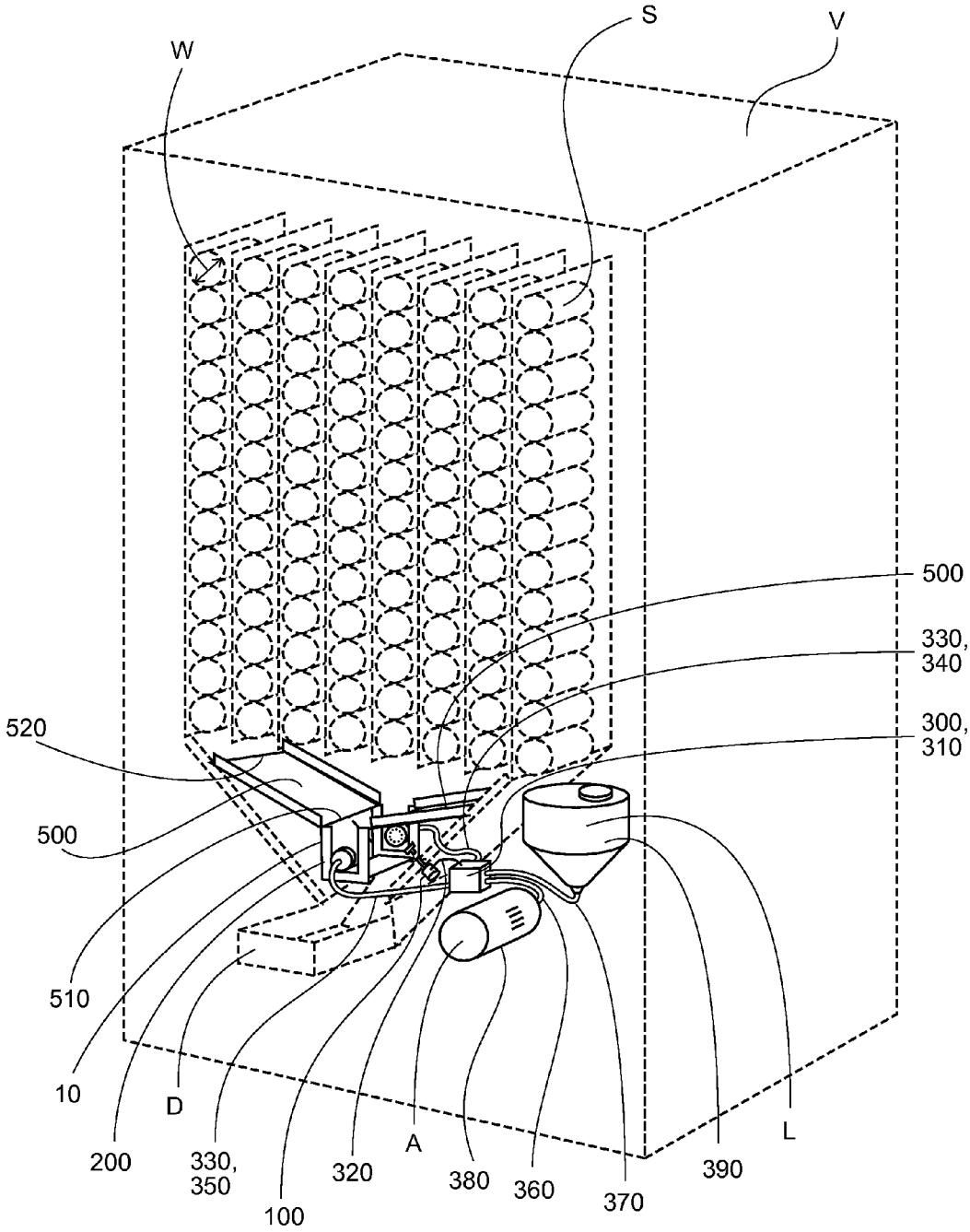
FIG. 1 is a perspective view of a preferred embodiment of beverage can cleaning apparatus, shown disposed within a soda can dispensing machine.
Figure 2A:
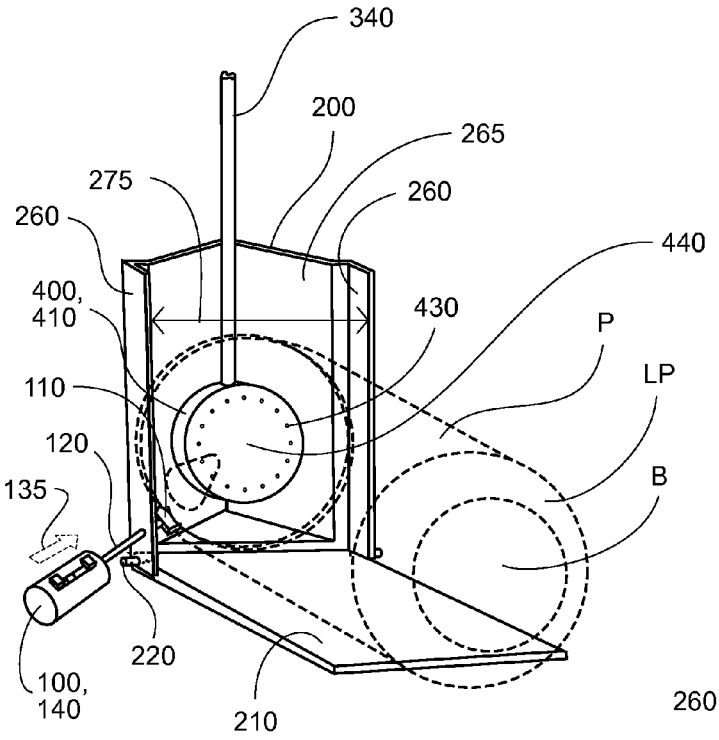
FIG. 2A is a partial perspective view of a sensor component and one end of a holder component of the apparatus of FIG. 1.
Figure 2B:
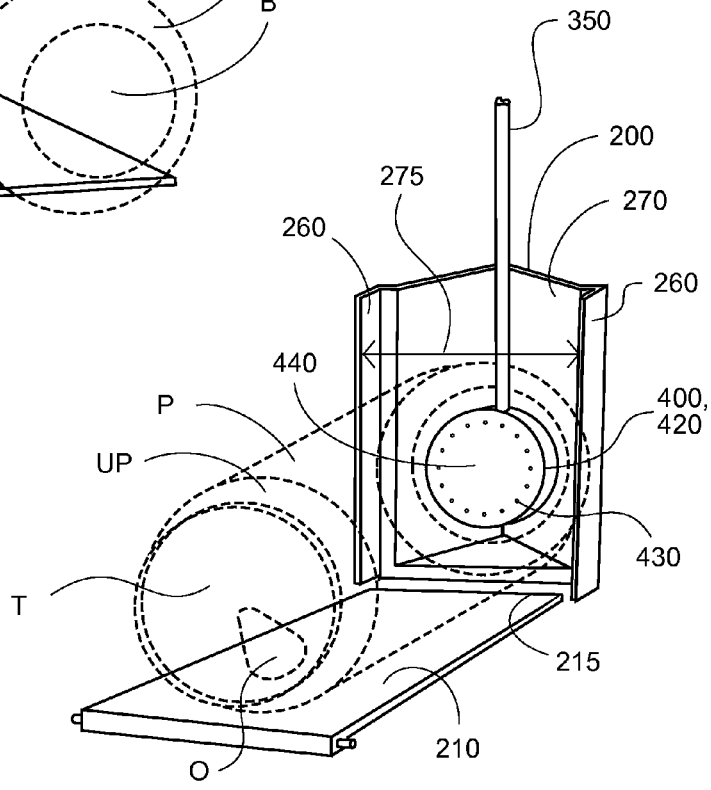
FIG. 2B is a perspective view of an opposite end of a the holder component of FIG. 2A.

Referring now to FIGS. 1, 2A and 2B, the present invention in a preferred embodiment is beverage can cleaner 10, wherein beverage can cleaner 10 comprises sensing apparatus 100, holder 200, controlling system 300 and ramps 500, wherein ramps 500 comprise ramp bottom 510 and ramp top 520. Ramps 500 are angularly disposed, wherein ramp bottom 510 is disposed lower than ramp top 520, and ramp bottom 510 is fixedly secured to holder 200.

Referring more specifically to FIGS. 2A and 2B, holder 200 comprises hinge 220, side walls 260, first vertical wall 265, second vertical wall 270, holder diameter 275, nozzles 400 and platform 210, wherein platform 210 comprises end 215. Nozzles 400 comprise first nozzle 410 and second nozzle 420, wherein both first nozzle 410 and second nozzle 420 each comprise nozzle apertures 430 and nozzle face 440.

Figure 3A:
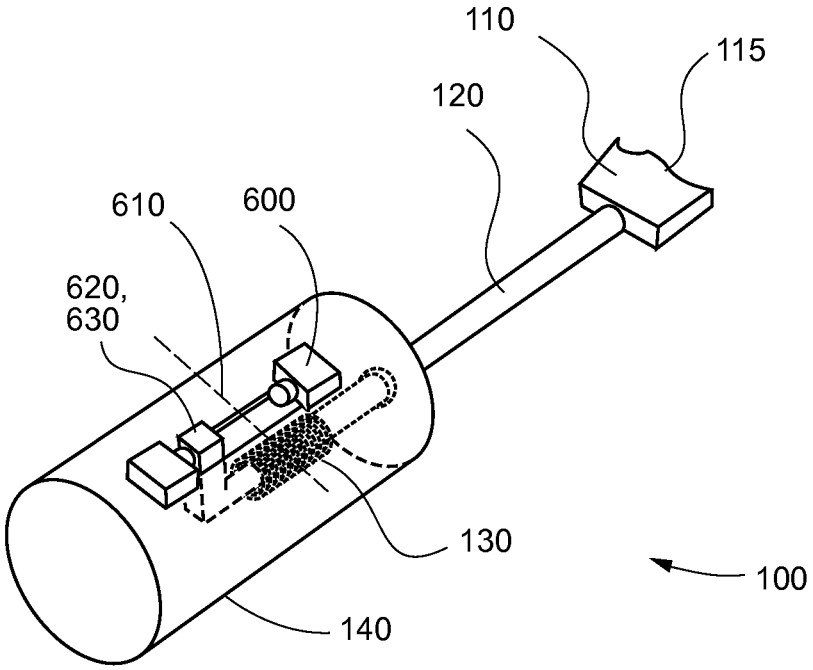
FIG. 3A is a detail view of the sensor of FIG. 1.
Figure 3B:
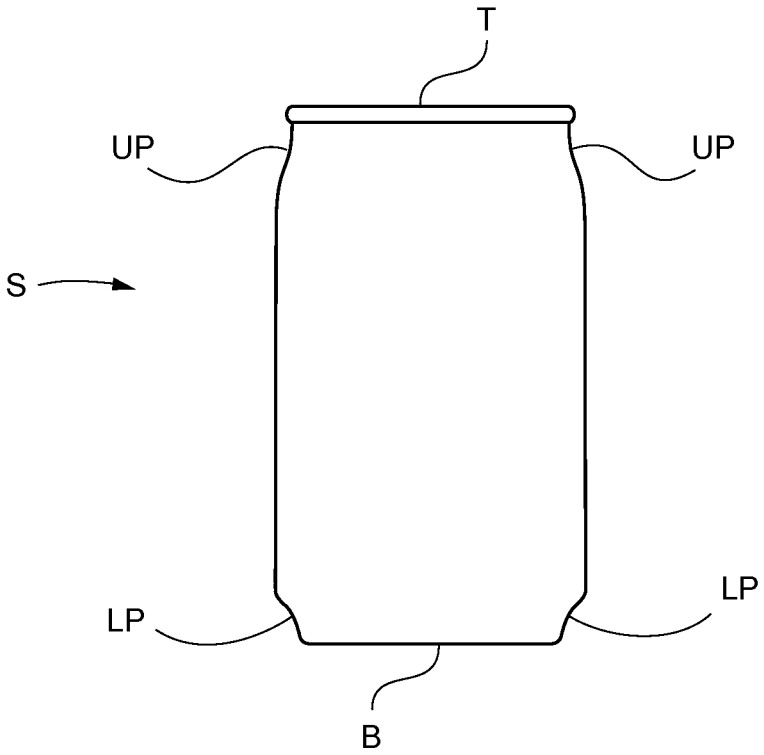
FIG. 3B PRIOR ART
FIG. 3B is a side view of a prior art typical soda can.

Turning now to FIG. 3A, sensing apparatus 100 comprises sensing block 110, rod 120, spring 130 and sensor 140, wherein sensing block 110 comprises surface 115, wherein sensing block 110 is fixedly secured to rod 120, and wherein rod 120 is in communication with sensor 140. Surface 115 of sensing block 110 is preferably similarly contoured to upper perimeter UP of soda can S.

Spring 130 is a resilient metal coil that is compressible and is disposed within sensor 140. When compressed, spring 130 exerts force 135 on rod 120. However, it will be recognized by those skilled in the art that spring 130 may comprise any compressible material that will exert force 135 when compressed. Sensor 140 comprises uncompressed distance 600, first distance 610, second distance 620 and compressed distance 630, and wherein if no soda can S is in holder 200, then rod 120 is disposed at uncompressed distance 600.

Referring back to FIGS. 1, 2A and 2B, controlling system 300 comprises controller 310, wire 320, nozzle tubes 330, compressed air tube 360, cleaning liquid tube 370, compressed air container 380 and cleaning liquid container 390, wherein nozzle tubes 330 comprise first nozzle tube 340 and second nozzle tube 350, and wherein cleaning liquid container 390 has liquid L disposed therewithin, and wherein compressed air container 380 has compressed air A disposed therewithin.

Beverage can cleaner 10 is disposed within vending machine V proximate to machine exit chamber D, wherein vending machine V typically is an automated machine for dispensing soda cans S, and wherein soda cans S exit vending machine V via machine exit chamber D. Soda can S comprises can diameter W (best shown in FIG. 1), can bottom B (best shown in FIG. 2A), can periphery P (best shown in FIGS. 2A and 2B), and can top T (best shown in FIG. 2B), wherein can top T comprises can opening O, and wherein can periphery P comprises upper perimeter UP and lower perimeter LP (best shown in FIG. 3B), and wherein upper perimeter UP is disposed proximate to can top T (best shown in FIG. 2B), and wherein lower perimeter LP is disposed proximate to can bottom B (best shown in FIG. 2A).

Compressed air container 380 is in fluid communication with controller 310 via compressed air tube 360, and cleaning liquid container 390 is in fluid communication with controller 310 via cleaning liquid tube 370. Controller 310 is in fluid communication with first nozzle tube 340 and second nozzle tube 350. Further, compressed air tube 360 and cleaning liquid tube 370 are each selectively in fluid communication with respective first nozzle tube 340 and second nozzle tube 350 via controller 310. Controller 310 is in electrical communication with sensing apparatus 100 via wire 320.

Turning now to FIGS. 2A and 2B, in a preferred embodiment platform 210 is hingedly secured at or proximate to side walls 260 via hinge 220 (best shown in FIG. 2A). However, it will be recognized by those skilled in the art that platform 210 may be hingedly secured to holder 200 other than at or proximate to side walls 260.

Side walls 260 are fixedly secured to first vertical wall 265 (best shown in FIG. 2A) and second vertical wall 270 (best shown in FIG. 2B). Side walls 260 preferably comprise two side walls 260, wherein side walls 260 are disposed holder diameter 275 apart from each other, and wherein holder diameter 275 is approximately equal and slightly greater than can diameter W. Rod 120 of sensing apparatus 100 is preferably disposed through side walls 260.

First nozzle tube 340 is in fluid communication with nozzle apertures 430 of first nozzle 410, and second nozzle tube 350 is in fluid communication with nozzle apertures 430 of second nozzle 420. In a preferred embodiment, nozzle apertures 430 are disposed peripherally equidistant from each other on nozzle face 440 (best shown in FIGS. 2A *and* 2B). First nozzle 410 is disposed proximate to first vertical wall 265, and second nozzle 420 is disposed proximate to second vertical wall 270.

Turning to FIG. 1, in use vending machine V vends soda can S onto ramp 500, wherein can periphery P contacts ramp 500. Gravity forces soda can S to roll towards ramp bottom 510, and subsequently soda can S falls into holder 200.

Turning now to FIGS. 2A and 2B, when soda can S is disposed within holder 200, sensing block 110 is in contact with either upper perimeter UP (best shown in FIG. 2A) or lower perimeter LP of soda can S (not shown), and rod 120 will be forced to retract compressed distance 630 into sensor 140, wherein compressed distance 630 is preferably equal to either first distance 610 or second distance 620. Because upper perimeter UP and lower perimeter LP are dimensioned differently, and further because surface 115 of sensing block 110 is preferably contoured similarly to upper perimeter UP, rod 120 compresses to first distance 610 only if sensing block 110 is in contact with upper perimeter UP, and rod 120 compresses to second distance 620 only if sensing block 110 is in contact with lower perimeter LP.

Specifically, and for illustrative purposes, if surface 115 of sensing block 110 is in contact with lower perimeter LP of soda can S, because surface 115 is similarly contoured to upper perimeter UP, and thus differently than lower perimeter LP, sensing block 110 will be depressed second distance 620, wherein second distance 620 is preferably greater than first distance 610. However, and again for illustrative purposes, if surface 115 of sensing block 110 is in contact with upper perimeter UP of soda can S, because surface 115 is contoured similarly to upper perimeter UP, sensing block 110 will be depressed first distance 610, wherein first distance 610 is preferably less than second distance 620.

Sensor 140 subsequently electrically communicates either first distance 610 or second distance 620 to controller 310. Based on whether sensor 140 communicates first distance 610 or second distance 620, controller 310 is able to determine whether can top T or can bottom B is disposed proximate to first nozzle 410 or second nozzle 420.

If sensor 140 communicates first distance 610 to controller 310, then controller 310 selectively causes liquid L to flow from cleaning liquid container 390 through cleaning liquid tube 370 and first nozzle tube 340, ultimately exiting from nozzle apertures 430 of first nozzle 410 against can top T of soda can S. Subsequently, controller 310 selectively causes compressed air A to flow from compressed air container 380 through compressed air tube 360 and first nozzle tube 340, ultimately exiting from nozzle apertures 430 of first nozzle 410 against can top T of soda can S.

However, if sensor 140 communicates second distance 620 to controller 310, then controller 310 selectively causes liquid L to flow from cleaning liquid container 390 through cleaning liquid tube 370 and second nozzle tube 350, ultimately exiting from nozzle apertures 430 of second nozzle 420 against can top T of soda can S. Subsequently, controller 310 selectively causes compressed air A to flow from compressed air container 380 through compressed air tube 360 and second nozzle tube 350, ultimately exiting from nozzle apertures 430 of second nozzle 420 against can top T of soda can S.

Subsequent to liquid L and compressed air A being dispensed against can top T, controller 310 permits platform 210 to rotate about hinge 220, wherein end 215 rotates away from second vertical wall 270 until soda can S falls into machine exit chamber D.

In a preferred embodiment, liquid L comprises an antibacterial substance approved by the U.S. Food and Drug Administration for the use described herein. It will be recognized by those skilled in the art that liquid L may comprise any substance that will clean can top T, including, for exemplary purposes only and without limitation, water. Further, liquid L and compressed air A are preferably dispensed against can top T for three seconds, but it will be recognized by those skilled in the art that liquid L and compressed air A can each respectively be dispensed against cap top T for any amount of time deemed necessary.

In a preferred embodiment controller 310 also comprises a mechanism to regulate and/or increase the pressure of liquid L and compressed air A as they are dispensed into nozzle tubes 330.

Figure 4:
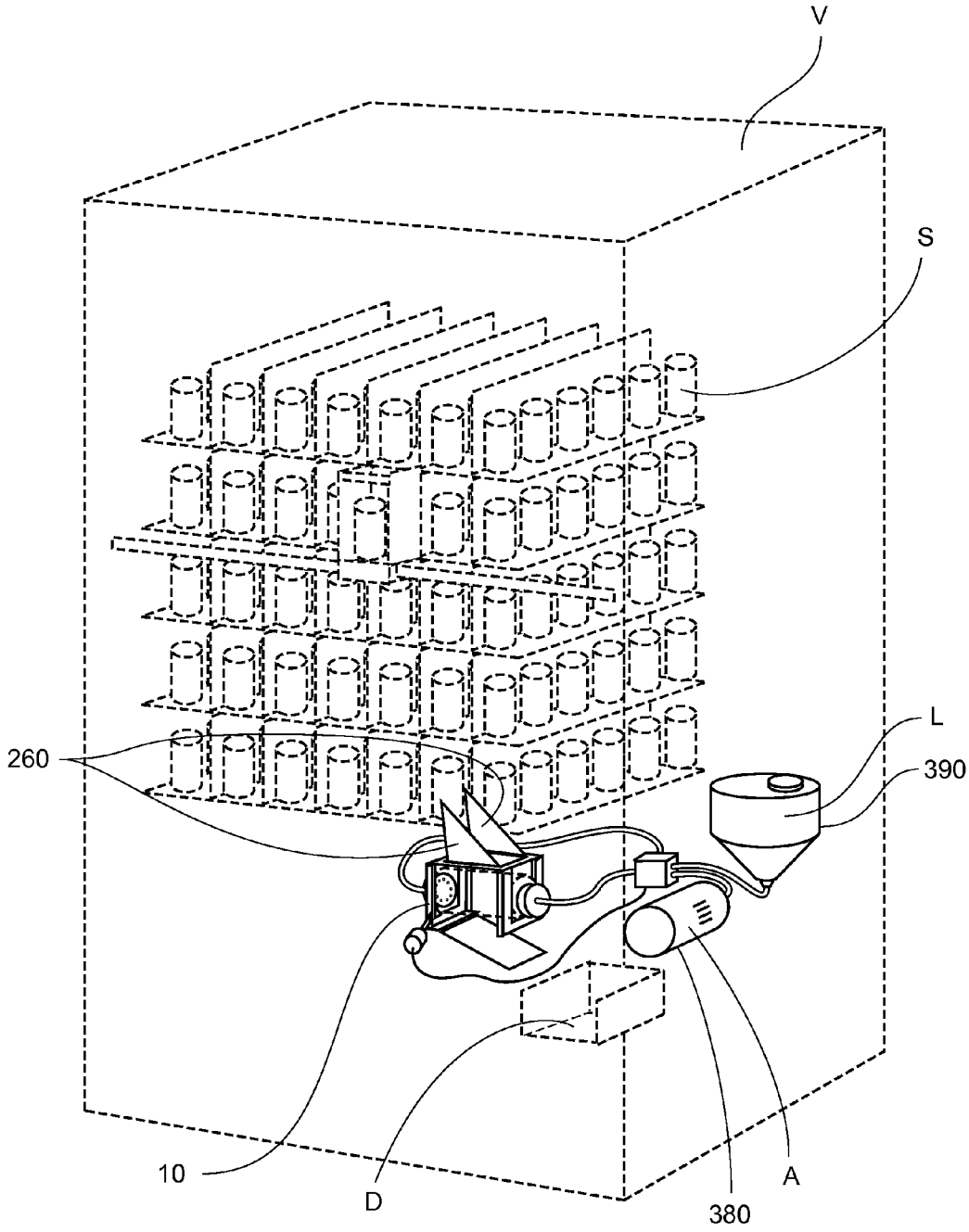
FIG. 4 is an alternate embodiment beverage can cleaning apparatus, shown disposed within a soda can dispensing machine.

Referring now more specifically to FIG. 4, illustrated therein is an alternate embodiment of beverage can cleaner 10, wherein the alternate embodiment of FIG. 4 is substantially equivalent in form and function to that of the preferred embodiment detailed and illustrated in FIGS. 1-3A except as hereinafter specifically referenced. Specifically, the alternate embodiment of FIG. 4 lacks ramp 500. Instead, vending machine V dispenses soda can S directly into holder 200.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A beverage can cleaning apparatus for a beverage can having a can top with an upper perimeter of a specific shape and a can bottom, said beverage can cleaning apparatus comprising:

a holder configured to hold the beverage can, wherein said holder comprises a first holder end and a second holder end, said first holder end and said second holder end positioned proximate one of the can top and the can bottom;

a pair of nozzles, said pair of nozzles comprises a first nozzle positioned proximate said first holder end and a second nozzle positioned proximate said second holder end;

a sensing apparatus positioned proximate said first holder end, wherein said sensing apparatus further comprises a rod having a first end and a second end, wherein said rod is configured with a sensing block fixedly secured to said first end of said rod, wherein said sensing block comprises a surface dimensioned to match the shape of the upper perimeter of the can top; and a sensor positioned proximate said second end of said rod, wherein said rod is forced a compressed distance into said sensor; and a controller configured to activate one of said pair of nozzles, wherein said controller is in electrical communication with said sensing apparatus.

2. The beverage can cleaning apparatus of claim 1, wherein said compressed distance is equal to a first distance if said sensing block is in contact with the can top, and wherein said compressed distance is equal to a second distance if said sensing block is in contact with the can bottom.

3. The beverage can cleaning apparatus of claim 2, wherein said controller is in electrical communication with said sensor, and wherein said sensor communicates said compressed distance to said controller.

4. The beverage can cleaning apparatus of claim 3, further comprises a first nozzle tube, wherein said first nozzle tube is in fluid communication with said first nozzle and a second nozzle tube, wherein said second nozzle tube is in fluid communication with said second nozzle.

5. The beverage can cleaning apparatus of claim 4, said beverage can cleaning apparatus further comprising:

a cleaning liquid container; and a cleaning liquid tube, wherein said cleaning liquid tube is in fluid communication with said cleaning liquid container, and wherein said cleaning liquid tube is selectively in fluid communication with one of said first nozzle tube and said second nozzle tube.

6. The beverage can cleaning apparatus of claim 4, said beverage can cleaning apparatus further comprising:

a compressed air container; and a compressed air tube, wherein said compressed air tube is in fluid communication with said compressed air container, and wherein said compressed air tube is selectively in fluid communication with one of said first nozzle tube and said second nozzle tube.

7. The beverage can cleaning apparatus of claim 5, wherein said controller selectively couples said cleaning liquid air tube in fluid communication with said first nozzle tube if said compressed distance is equal to said first distance, and wherein said controller selectively couples said cleaning liquid tube in fluid communication with said second nozzle tube if said compressed distance is equal to said second distance.

8. The beverage can cleaning apparatus of claim 1, wherein said holder further comprises a platform, and wherein said platform is hingedly secured to said holder, and wherein the beverage can rests on said platform when the beverage can is within said holder.

9. The beverage can cleaning apparatus of claim 6, wherein said controller selectively couples said compressed air tube in fluid communication with said first nozzle tube if said compressed distance is equal to said first distance, and wherein said controller selectively couples said compressed air tube in fluid communication with said second nozzle tube if said compressed distance is equal to said second distance.

10. The beverage can cleaning apparatus of claim 9, wherein said first nozzle and said second nozzle each comprise apertures.

* * * * *